US010472200B2

(12) United States Patent
Re et al.

(10) Patent No.: US 10,472,200 B2
(45) Date of Patent: Nov. 12, 2019

(54) TELESCOPIC PNEUMATIC LINEAR ACTUATOR, PARTICULARLY FOR UNWINDERS WITH MOVABLE ARMS

(71) Applicant: RENOVA S.R.L., Milan (IT)

(72) Inventors: Giampiero Re, Milan (IT); Andrea Fantasia, Bresso (IT)

(73) Assignee: RENOVA S.R.L., Milan (IT)

( * ) Notice: Subject to any disclaimer, the term of this patent is extended or adjusted under 35 U.S.C. 154(b) by 171 days.

(21) Appl. No.: 15/289,999

(22) Filed: Oct. 11, 2016

(65) Prior Publication Data

US 2017/0102014 A1 Apr. 13, 2017

(30) Foreign Application Priority Data

Oct. 9, 2015 (IT) ..... 102015000059875

(51) Int. Cl.

| | |
|---|---|
| ***B65H 75/24*** | (2006.01) |
| ***B21C 47/30*** | (2006.01) |
| ***A47K 10/40*** | (2006.01) |
| ***F15B 15/16*** | (2006.01) |
| ***B65H 16/04*** | (2006.01) |
| ***B65H 19/12*** | (2006.01) |
| *F15B 15/14* | (2006.01) |

(52) U.S. Cl.

CPC ..... *B65H 75/242* (2013.01); *A47K 10/40* (2013.01); *B21C 47/30* (2013.01); *B65H 16/04* (2013.01); *B65H 19/12* (2013.01); *F15B 15/16* (2013.01); *B65H 2301/4136* (2013.01); *B65H 2301/41324* (2013.01); *B65H 2402/343* (2013.01); *B65H 2555/11* (2013.01); *F15B 15/1433* (2013.01)

(58) Field of Classification Search

CPC .... F15B 15/16; F15B 2211/7057; F01B 7/20; A47K 10/40; B65H 75/02; B65H 75/18; B65H 75/185; B65H 2555/11; B65H 2555/12; B65H 75/242; B65H 75/246; B65H 75/247; B65H 75/248; B21C 47/30

See application file for complete search history.

(56) References Cited

U.S. PATENT DOCUMENTS 3,477,655 A * 11/1969 Anderson ..... B21C 47/34 242/534.1

4,366,932 A 1/1983 Focke (Continued)

FOREIGN PATENT DOCUMENTS

| | | |
|---|---|---|
| CN | 201952030 U | 8/2011 |
| CN | 202030351 U | 11/2011 |
| CN | 103434674 A | 12/2013 |

(Continued)

*Primary Examiner* — Thomas E Lazo
*Assistant Examiner* — Michael Quandt
(74) *Attorney, Agent, or Firm* — Cantor Colburn LLP

(57) ABSTRACT

A telescopic pneumatic linear actuator, particularly for unwinders with movable arms, includes a first annular cylinder, provided with a respective cavity, and a second annular cylinder, which can be inserted into and can slide within the cavity of the first annular cylinder and is provided with a respective cavity. The actuator also includes an annular piston, which can be inserted into and can slide within the cavity of the second annular cylinder. The first and second annular cylinders and the annular piston are provided with respective holes for the passage of a self-expanding spindle.

9 Claims, 7 Drawing Sheets

(56) References Cited

U.S. PATENT DOCUMENTS

| | | | | | |
|---|---|---|---|---|---|
| 4,516,468 | A | * | 5/1985 | Sheriff | F15B 15/16<br>91/169 |
| 4,767,077 | A | * | 8/1988 | Kataoka | B65H 75/246<br>242/571.7 |

FOREIGN PATENT DOCUMENTS

| | | | |
|---|---|---|---|
| CN | 204237304 | U | 4/2015 |
| CN | 204588200 | U | 8/2015 |
| CN | 204802722 | U | 11/2015 |
| DE | 136170 | A1 | 6/1979 |

* cited by examiner

TELESCOPIC PNEUMATIC LINEAR ACTUATOR, PARTICULARLY FOR UNWINDERS WITH MOVABLE ARMS

CROSS REFERENCE TO RELATED APPLICATIONS

This application is related to and claims the benefit of Italian Patent Application No. 102015000059875, filed on Oct. 9, 2015, the contents of which are herein incorporated by reference in their entirety.

TECHNICAL FIELD

The present disclosure relates to a telescopic pneumatic linear actuator, particularly for unwinders with movable arms. The telescopic pneumatic linear actuator described herein is particularly, although not exclusively, useful and practical in the area of operations to unload spools of paper, cardboard, corrugated cardboard and flexible laminates in general, these spools being supported by spindles that self-expand on mechanical command which are installed on unwinders with movable arms.

BACKGROUND

Nowadays, the use is known of spindles that self-expand on mechanical command which are installed on one end of each moveable arm comprised in unwinders adapted to support and rotate spools of paper, cardboard, corrugated cardboard and flexible laminates in general, in order to enable the processing thereof in the production process.

The operation of these conventional self-expanding spindles, which as mentioned operate on mechanical command, involves the radial expansion of blocks actuated by a supporting pin which is eccentric in shape and is integral with the bearing transmission shaft of the unwinder with movable arms.

Such blocks exit automatically from the self-expanding spindles upon the rotation by a fraction of a turn of the supporting shaft of the unwinder, and they make it possible to retain and center a spool, and also to support its weight during rotation.

This principle of operation of conventional self-expanding spindles has the advantage of exerting a high radial force for clamping the spool, since the blocks take advantage of the eccentricity of the supporting pin. In particular, this radial force is exerted on the internal part of the spool, called the "core", around which the paper or the like is wound and which is made of very robust material.

However, such conventional self-expanding spindles have the drawback that this clamping is substantially irreversible, so that the core of the spool remains coupled to at least one self-expanding spindle during the operations to unload the spool, thus necessitating difficult manual interventions by the operators for its removal, which very often cause consequent damage to the core.

Note that the cores of the spools must necessarily be recovered undamaged in order to enable their subsequent reuse, and therefore their damage implies a considerable economic burden that negatively influences production management.

Furthermore, the manual interventions in order to free the cores of the spools are typically carried out by way of levers and in restricted spaces, with consequent operational hazards and risk of injury for the operators.

Another drawback of the conventional self-expanding spindles consists in that they do not offer the possibility to unload spools that are not completely used, which need to be recovered in order to be reused in subsequent processing cycles, at the center of the unwinding station and in conditions of safety.

These partially used spools have masses in the order of hundreds of kilograms and when, during the unloading operations, they remain coupled to at least one self-expanding spindle, their expulsion and their movement is very difficult and problematic.

The situation described up to this point has led the producers of unwinders with movable arms to provide servomechanisms to be placed at the rear of the self-expanding spindles, so as to automatically perform the operations of expulsion and unloading of the spools, for example by way of a remote command and without the presence of operators in the area of the unwinding station, so as to avoid downtimes, risk of injury and, more generally, to remedy the above mentioned drawbacks.

Since conventional self-expanding spindles are typically flanged to the supporting shaft of the unwinder with movable aims, these servomechanisms comprise at least one annular pusher, fitted between the self-expanding spindle and a moveable arm, in particular being fixed on the moveable arm so as to be able to exert a pushing force originating from the rear side of the self-expanding spindle.

Currently, the solutions in use comprise an annular cylinder, inside which an annular piston slides which is moved by compressed air that provides a pushing force proportional to its area and which performs half of the necessary stroke for the expulsion of the spools from the self-expanding spindles.

Once the halfway point of the stroke is reached, the annular piston places under pressure a series of smaller, auxiliary pistons of reduced diameter or cross-section.

The movement di these auxiliary pistons makes it possible to perform the full stroke necessary for the expulsion of the spools from the self-expanding spindles, unloading them at the center of the area of the unwinding station.

However, such conventional solutions are not devoid of operational and economic drawbacks, among which is the fact that the pushing force, exerted on the spool for its expulsion from the self-expanding spindles, is determined by the diameter, i.e. by the cross-section, of the auxiliary pistons, and so in practice the pushing force is of reduced value, and therefore is not adapted to the expulsion of spools of considerable mass.

Another drawback of such conventional solutions consists in that they have large diameters due to the complexity of their construction, which entail a consequent limitation of the useful spaces available for the angular movements of the moving arms of the unwinders.

A further drawback of such conventional solutions consists in that they have large longitudinal dimensions due to the complexity of their construction, which entail a consequent limitation of the useful spaces available for the rotation and movement (loading and unloading) of the spools supported by the self-expanding spindles, and also a widening of the structure of the moving arms.

Another drawback of such conventional solutions consists in that they have considerable costs of provision owing to the high number of components that constitute them, and such components also require high-precision mechanical machining, together with the need to be made from steel.

SUMMARY

The present disclosure overcomes the limitations of the known art described above, by devising a telescopic pneumatic linear actuator, particularly for unwinders with movable arms, which makes it possible to obtain effects similar to or better than those that can be obtained with conventional solutions, making it possible to exert a pushing force, for the expulsion of the spool from the self-expanding spindles, which is sufficiently high to cover all the various needs and move any spool of any mass, without limitations.

Within this aim, the present disclosure provides a telescopic pneumatic linear actuator, particularly for unwinders with movable arms, which makes it possible to expel the spools from the self-expanding spindles and unload them correctly at the center of the unwinding station, even for spools that are partially used or which have damaged cores.

The present disclosure devises a telescopic pneumatic linear actuator that makes it possible to minimize the diameter size, in order to improve the angular movements of the moving arms of the unwinders.

The present disclosure also provides a telescopic pneumatic linear actuator that makes it possible to minimize the longitudinal dimensions, in order to improve the rotation and the movement (loading and unloading) of spools supported by the self-expanding spindles, and also in order to prevent a widening of the structure of the moving arms.

The present disclosure also devises a telescopic pneumatic linear actuator that makes it possible to reduce the average times of the operations of loading and unloading the spools on the unwinders with movable aims.

The present disclosure further provides a telescopic pneumatic linear actuator that makes it possible to eliminate any kind of manual intervention necessary for the expulsion and unloading of the spools clamped on at least one self-expanding spindle, with a consequent increase of the level of safety for the operators and for the unwinding station in general.

The present disclosure also devises a telescopic pneumatic linear actuator that can be used both on newly-designed unwinders with movable arms and, without particular mechanical modifications, for upgrading existing unwinders with movable arms which do not have a system or servomechanism for the automatic expulsion and unloading of the spools.

The present disclosure provides a telescopic pneumatic linear actuator, particularly for unwinders with movable arms, that is highly reliable, easily and practically implemented and economically competitive, for example by minimizing the number of components that constitute it.

These advantages which will become better apparent hereinafter are achieved by providing a telescopic pneumatic linear actuator, particularly for unwinders with movable arms, which comprises a first annular cylinder, provided with a respective cavity, wherein it comprises a second annular cylinder, which can be inserted into and can slide within said cavity of said first annular cylinder and is provided with a respective cavity, and an annular piston, which can be inserted into and can slide within said cavity of said second annular cylinder, said first and second annular cylinders and said annular piston being provided with respective holes for the passage of a self-expanding spindle.

BRIEF DESCRIPTION OF THE DRAWINGS

Further characteristics and advantages of the disclosure will become better apparent from the detailed description of a preferred, but not exclusive, embodiment of the telescopic pneumatic linear actuator, particularly for unwinders with movable arms, according to the disclosure, illustrated by way of non-limiting example in the accompanying drawings, wherein.

DETAILED DESCRIPTION OF THE DRAWINGS

Figure 1:
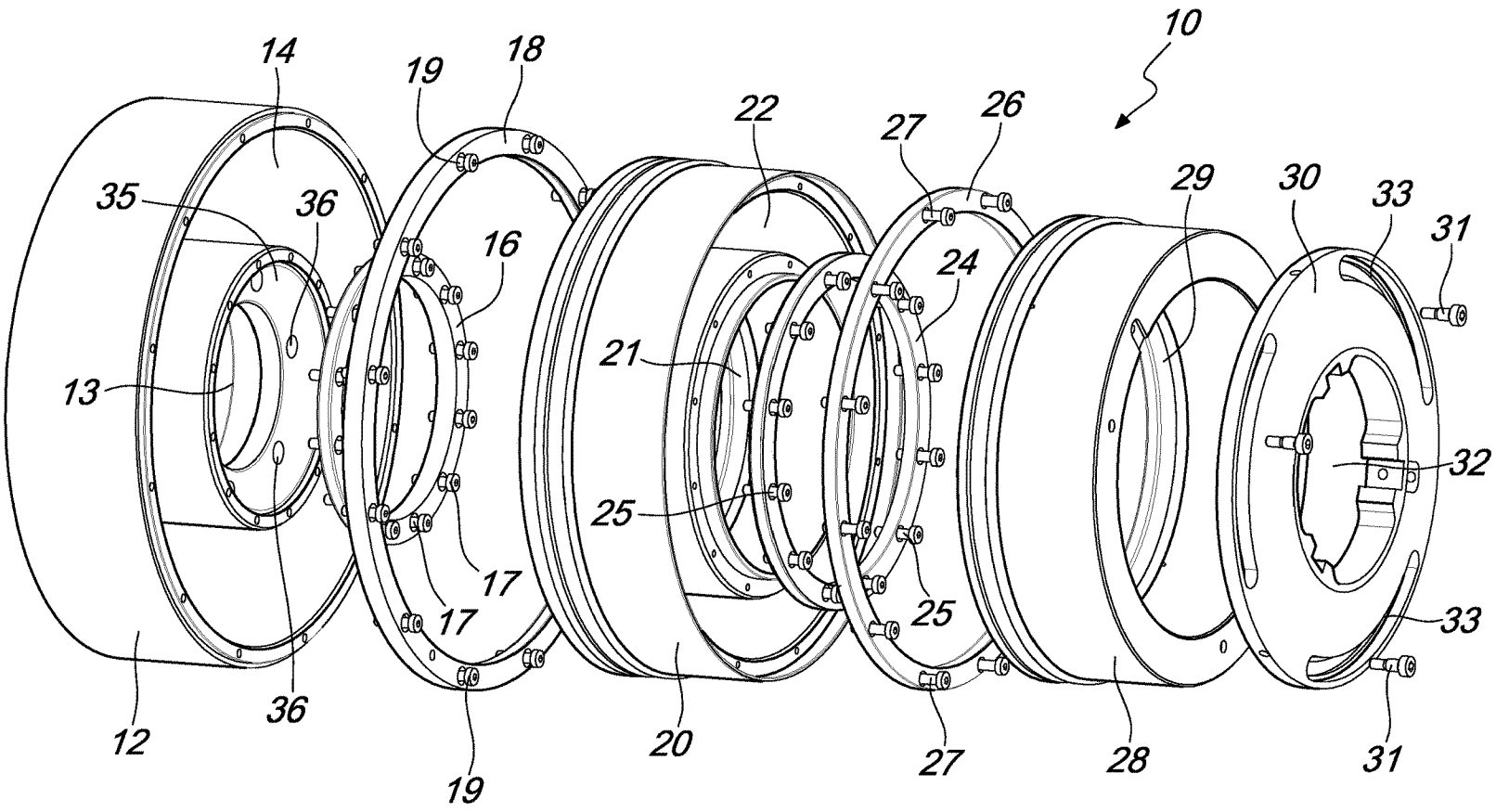
FIG. 1 is an exploded perspective view of an embodiment of the telescopic pneumatic linear actuator, particularly for unwinders with movable arms, according to the present disclosure.
Figure 2:
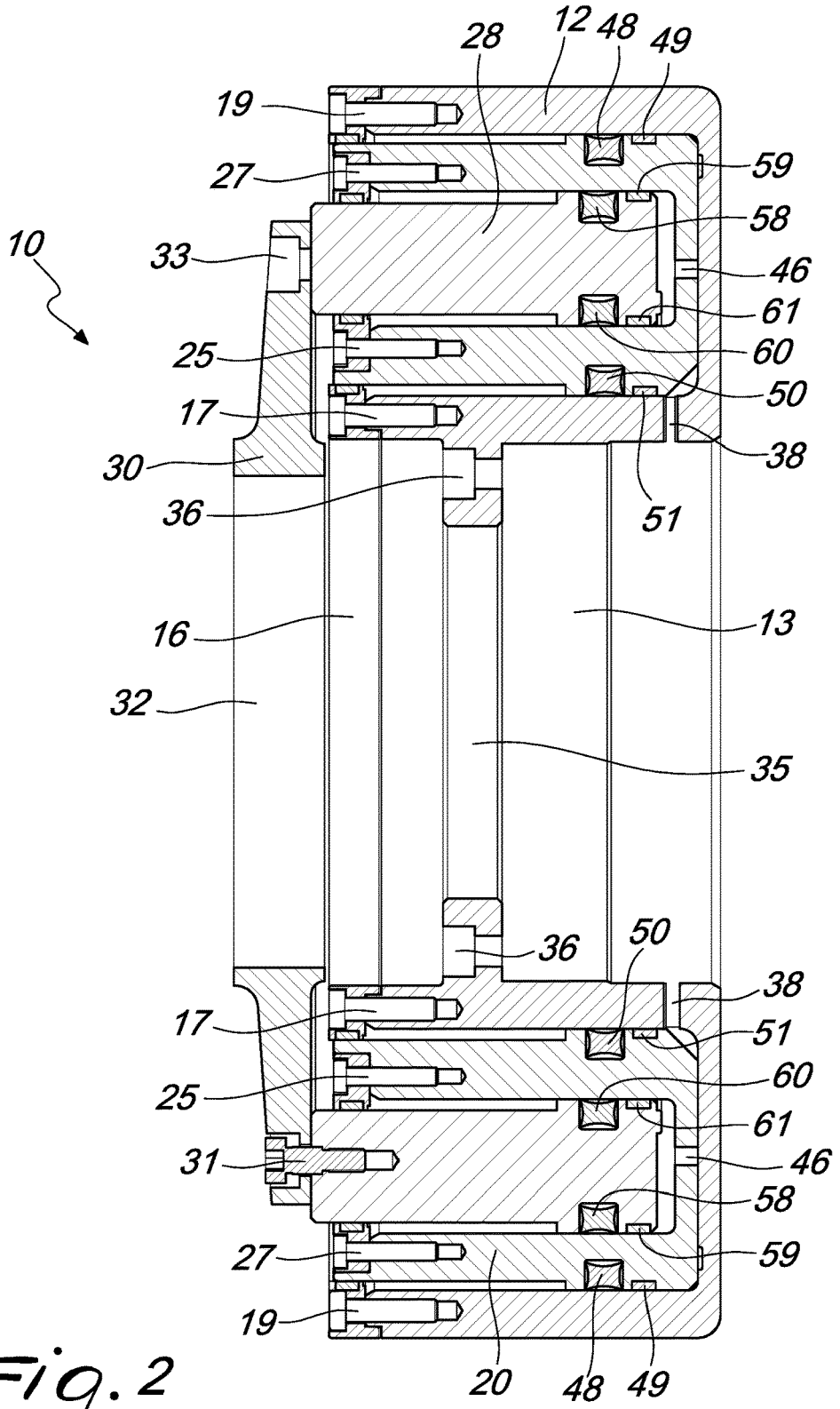
FIG. 2 is a longitudinal cross-sectional view of an embodiment of the telescopic pneumatic linear actuator, particularly for unwinders with movable arms, according to the present disclosure, in the closed configuration i.e. in the rest phase.
Figure 3:
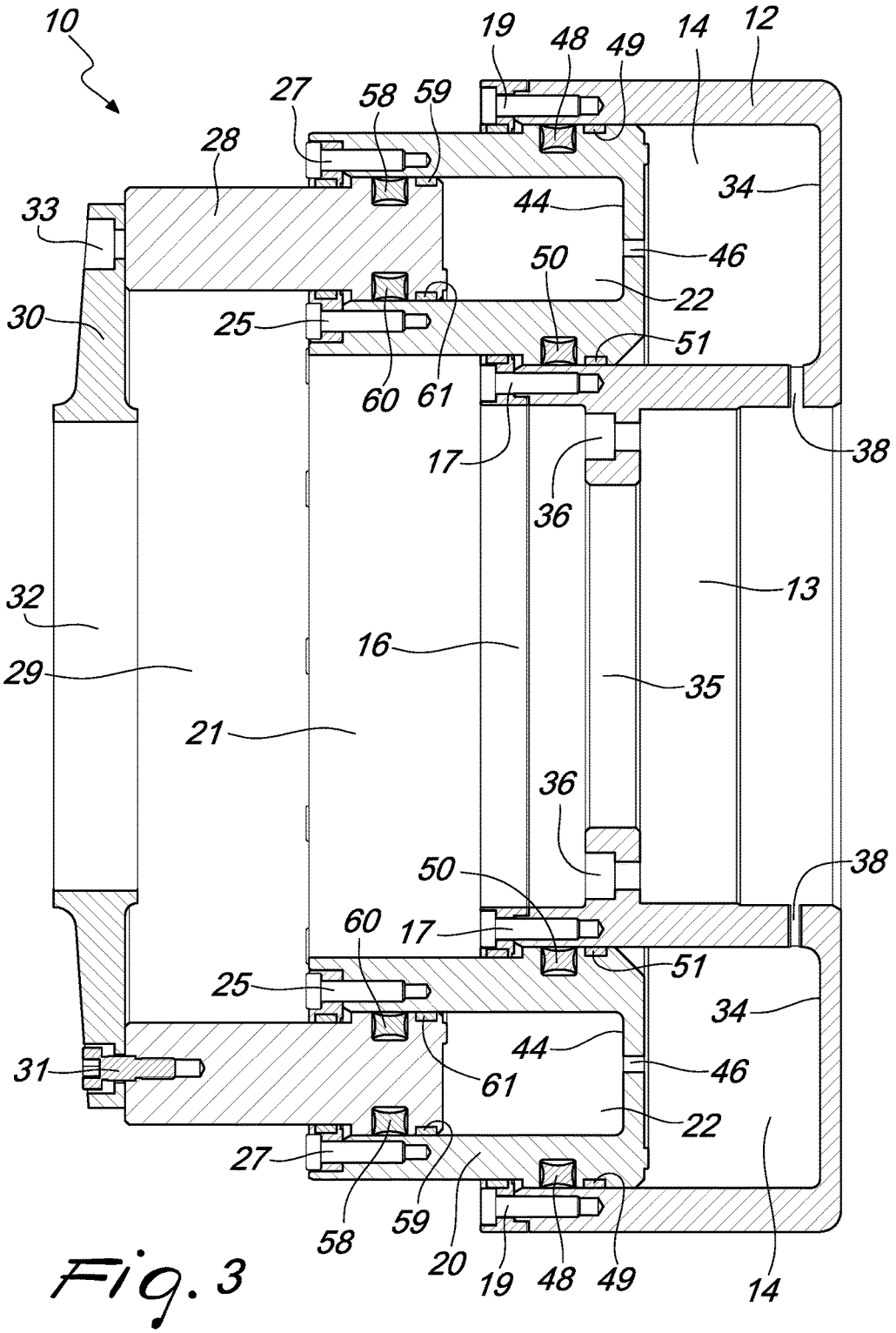
FIG. 3 is a longitudinal cross-sectional view of an embodiment of the telescopic pneumatic linear actuator, particularly for unwinders with movable arms, according to the present disclosure, in the open configuration i.e. in the fully extended phase.
Figure 4:
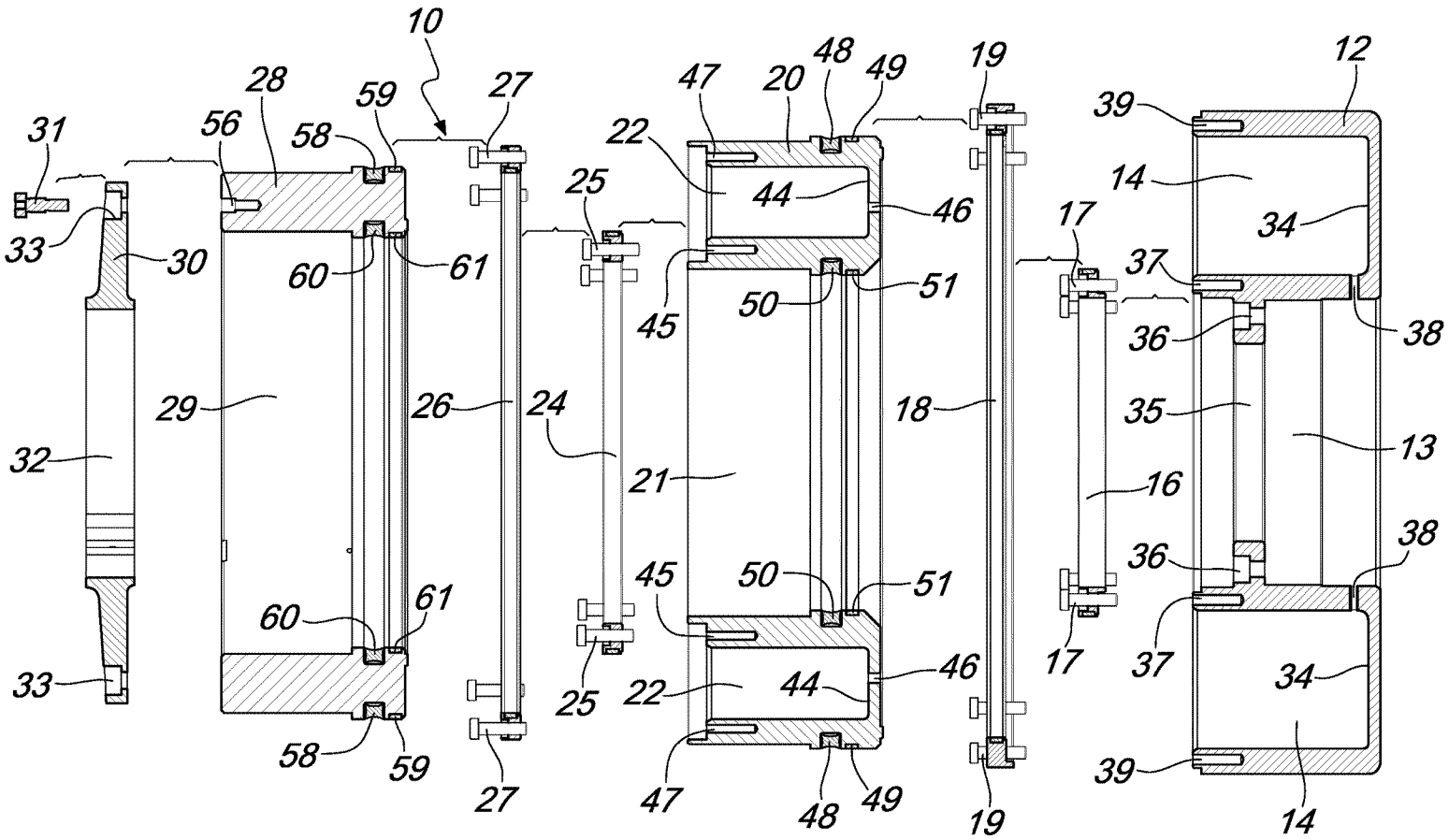
FIG. 4 is an exploded longitudinal cross-sectional view of an embodiment of the telescopic pneumatic linear actuator, particularly for unwinders with movable arms, according to the present disclosure.
Figure 5:
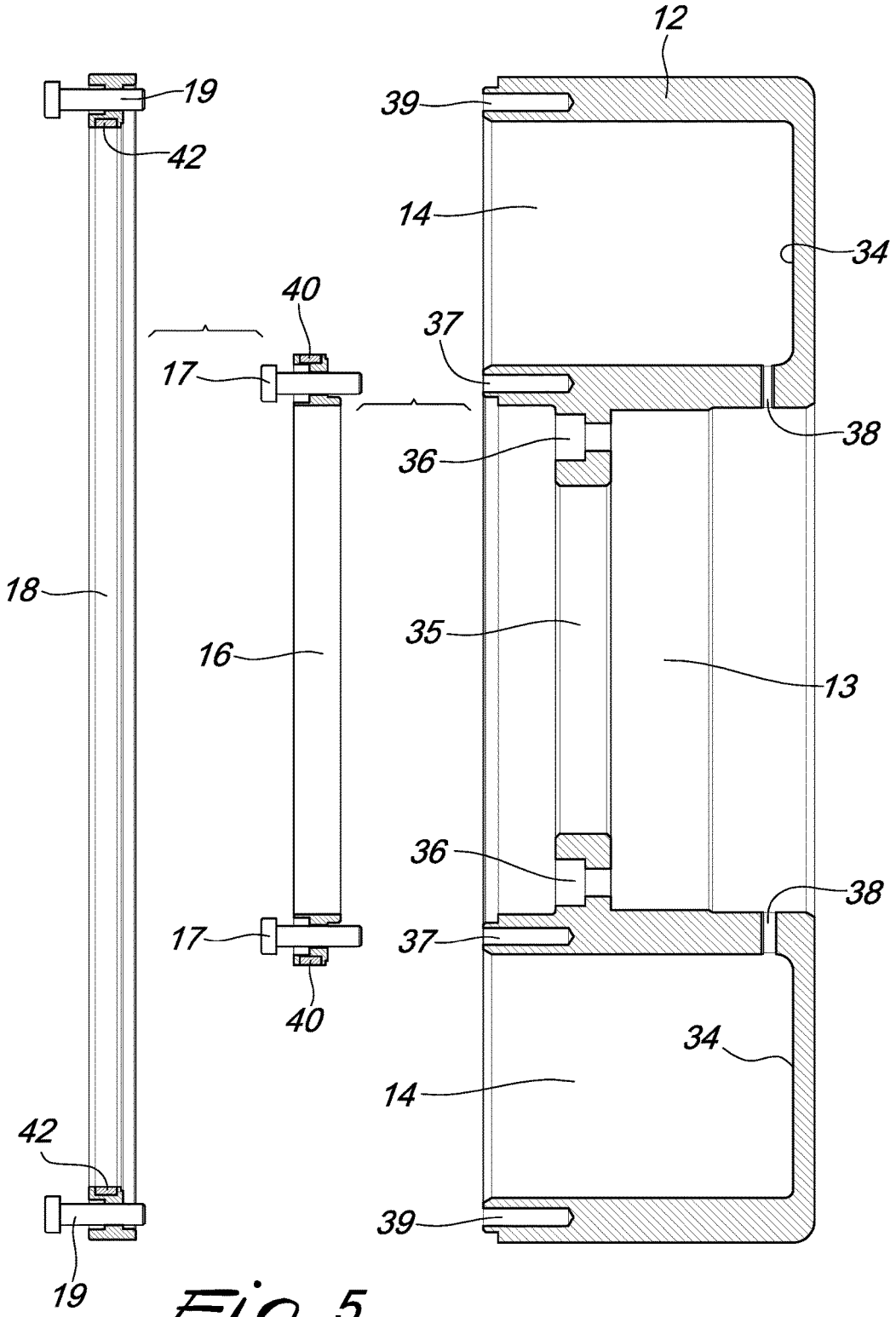
FIG. 5 is a longitudinal cross-sectional view of a first detail of an embodiment of the telescopic pneumatic linear actuator, particularly for unwinders with movable arms, according to the present disclosure.
Figure 6:
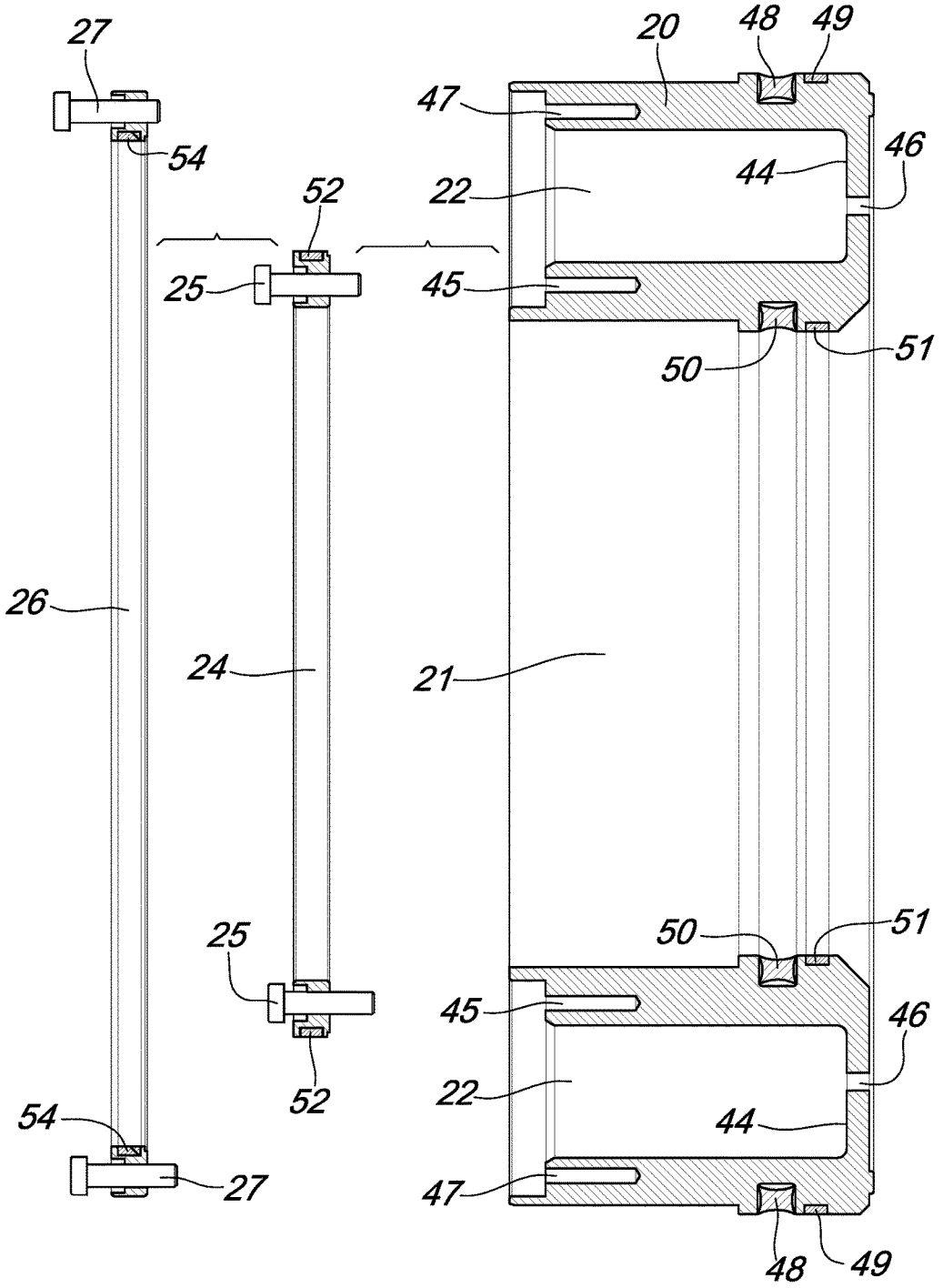
FIG. 6 is a longitudinal cross-sectional view of a second detail of an embodiment of the telescopic pneumatic linear actuator, particularly for unwinders with movable arms, according to the present disclosure.
Figure 8:
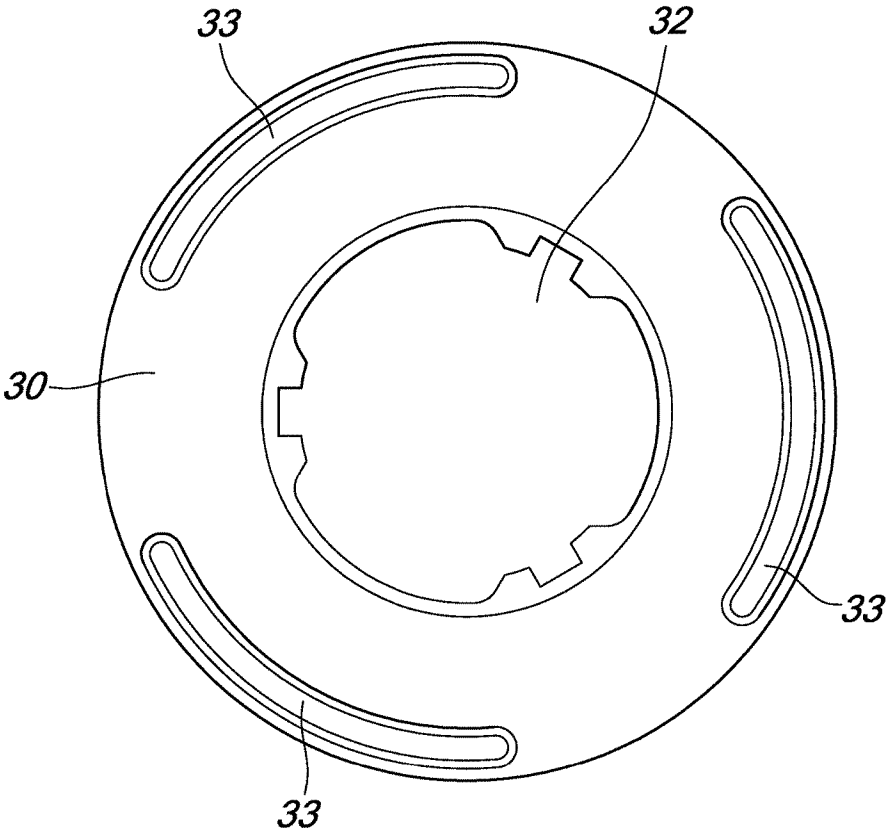
FIG. 8 is a front elevation view of a fourth detail of an embodiment of the telescopic pneumatic linear actuator, particularly for unwinders with movable arms, according to the present disclosure.
Figure 7:
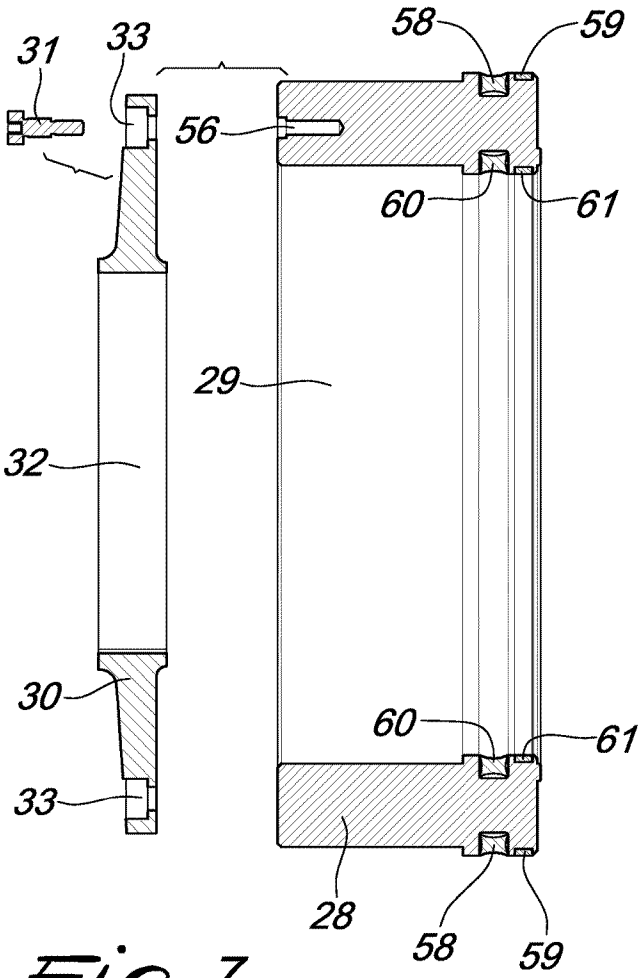
FIG. 7 is a longitudinal cross-sectional view of a third detail of an embodiment of the telescopic pneumatic linear actuator, particularly for unwinders with movable arms, according to the present disclosure.

With reference to the figures, a telescopic pneumatic linear actuator, particularly for unwinders with movable arms, according to the disclosure, generally designated by the reference numeral 10, substantially comprises a first annular cylinder 12, provided with a hole 13 and with a cavity 14, a second annular cylinder 20, which can be inserted into and can slide within the cavity 14 of the first annular cylinder 12 and is provided with a hole 21 and with a cavity 22, an annular piston 28, which can be inserted into and can slide within the cavity 22 of the second annular cylinder 20 and is provided with a hole 29, and an annular pusher plate 30 which can be fixed on the annular piston 28 and is provided with a hole 32.

The first annular cylinder 12 is constituted by a self-supporting annular body provided with the hole 13, for the passage of a conventional self-expanding spindle, and with the cavity 14, delimited at the rear by a bottom 34.

The first annular cylinder 12 is preferably made of light alloy and has reduced diametric and longitudinal dimensions.

This first annular cylinder 12 is supplied by compressed air, for example at a pressure of 6 bar, originating from at least one radial supply hole 38, which is defined proximate to the bottom 34 in the inner side of the first cylinder 12, thus connecting the hole 13 with the cavity 14.

The compressed air that supplies and actuates the telescopic pneumatic linear actuator 10 according to the disclosure originates from compression means, such as for example a compressor, external thereto.

The first annular cylinder 12 comprises in its inner side, at the hole 13 and in an intermediate position, a circular installation flange 35 with corresponding fixing holes 36, for the installation and fixing of the first cylinder 12, and consequently of the telescopic pneumatic linear actuator 10 according to the disclosure, on the bearing transmission shaft of an unwinder with movable arms.

The first annular cylinder 12 is associated with an inner stroke limiting ring 16 and an outer stroke limiting ring 18, which are fixed on the open side of the first annular cylinder 12 along the edges of the cavity 14.

The inner 16 and outer 18 stroke limiting rings are rendered integral with the first annular cylinder 12 using adapted connection means, which are constituted for example by screws 17 and 19 which can be screwed into the respective threaded seats 37 and 39 which are provided in the first annular cylinder 12 along the edges of the cavity 14.

The inner 16 and outer 18 stroke limiting rings are both adapted to arrest the stroke of the second annular cylinder 20 which can slide within the cavity 14 of the first annular cylinder 12.

The inner 16 and outer 18 stroke limiting rings of the first annular cylinder 12 are provided with respective anti-friction rings 40 and 42 for the centering and support of the second annular cylinder 20 which can slide within the cavity 14; in particular, the anti-friction ring 40 is arranged along the external profile of the inner stroke limiting ring 16, while the anti-friction ring 42 is arranged along the internal profile of the outer stroke limiting ring 18.

As previously mentioned, the second annular cylinder 20 is insertable into the cavity 14 of the above mentioned first annular cylinder 12, so as to be able to slide freely in a longitudinal direction along the axis of the bearing transmission shaft of an unwinder with movable arms.

The second cylinder 20 is constituted by a self-supporting annular body provided with a hole 21, for the passage of a conventional self-expanding spindle, and with a cavity 22, delimited at the rear by a bottom 44.

The second annular cylinder 20 is also preferably made of light alloy and has reduced diametric and longitudinal dimensions.

The second annular cylinder 20 is supplied by compressed air, for example at a pressure of 6 bar, originating from at least one longitudinal supply hole 46, which is defined at the bottom 44, thus connecting the cavity 22 with the cavity 14 of the first annular cylinder 12.

The second annular cylinder 20 has an outer gasket 48 at the rear, along its outer side, and an inner gasket 50, along its inner side at the hole 21, both for a pneumatic seal.

Parallel to and to the rear of the outer gasket 48 and inner gasket 50, the second annular cylinder 20 has an outer anti-friction ring 49 and an inner anti-friction ring 51, for the centering and support of the second annular cylinder 20 during its longitudinal sliding.

The second annular cylinder 20 is associated with an inner stroke limiting ring 24 and an outer stroke limiting ring 26, which are fixed on the open side of the second annular cylinder 20 along the edges of the cavity 22.

The inner 24 and outer 26 stroke limiting rings are rendered integral with the second annular cylinder 20 using adapted connection means, which are constituted for example by screws 25 and 27 which can be screwed into the respective threaded seats 45 and 47 which are provided in the second annular cylinder 20 along the edges of the cavity 22.

The inner 24 and outer 26 stroke limiting rings are both adapted to arrest the stroke of the annular piston 28 which can slide within the cavity 22 of the second annular cylinder 20.

The inner 24 and outer 26 stroke limiting rings of the second annular cylinder 20 are provided with respective anti-friction rings 52 and 54 for the centering and support of the annular piston 28 which can slide within the cavity 22; in particular, the anti-friction ring 52 is arranged along the external profile of the inner stroke limiting ring 24, while the anti-friction ring 54 is arranged along the internal profile of the outer stroke limiting ring 26.

As previously mentioned, the annular piston 28 is insertable into the cavity 22 of the above mentioned second annular cylinder 20, so as to be able to slide freely in a longitudinal direction along the axis of the bearing transmission shaft of an unwinder with movable arms.

The piston 28 is constituted by a self-supporting annular body provided with a hole 29, for the passage of a conventional self-expanding spindle.

The annular piston 28 is also preferably made of light alloy and has reduced diametric and longitudinal dimensions.

The annular piston 28 has an outer gasket 58 at the rear, along its outer side, and an inner gasket 60, along its inner side at the hole 29, both for a pneumatic seal.

Parallel to and to the rear of the outer 58 and inner 60 gaskets, the annular piston 28 has an outer anti-friction ring 59 and an inner anti-friction ring 61, for the centering and support of the annular piston 28 during its longitudinal sliding.

The annular piston 28 can be associated with a pusher plate 30, constituted by an annular plate which has a hole 32 for the passage of a conventional self-expanding spindle, and such annular plate 30 acts as a pusher in direct contact with the spool to be expelled from the conventional self-expanding spindles.

The annular pusher plate 30 is also preferably made of light alloy and has reduced diametric and longitudinal dimensions.

This annular pusher plate 30 is contoured so that it can rotate partially on its axis, so as to allow the automatic exit of the blocks from the conventional self-expanding spindles upon the rotation by a fraction of a turn of the supporting shaft of an unwinder with movable arms.

To this end, i.e. in order to enable this rotation, the annular pusher plate 30 is provided with longitudinally extended guides 33 defined proximate to the edge, and the hole 32 has a shape adapted to render the annular pusher plate 30 integral with a conventional self-expanding spindle.

The annular pusher plate 30 is coupled to the annular piston 28 using adapted connection means, which are constituted for example by screws 31 that engage in the guides 33 of the annular pusher plate 30 and can be screwed into the threaded seats 56 provided in the annular piston 28.

In a preferred embodiment of the telescopic pneumatic linear actuator 10 according to the disclosure, the first annular cylinder 12, the second annular cylinder 20 and the annular piston 28 can each be made monolithically from light alloy, considerably simplifying the construction of the actuator and containing the corresponding costs.

Operation of the telescopic pneumatic linear actuator 10, particularly for unwinders with movable arms, according to the disclosure is the following.

Initially the telescopic pneumatic linear actuator 10 according to the disclosure is in the closed configuration, i.e. in the rest phase.

When, in the production process, it is necessary to expel a used or partially used spool from the self-expanding spindles and unload it at the center of the unwinding station, an operator acts on a remote command, for example of the electronic type, which is adapted to start the pushing of the telescopic pneumatic linear actuator 10 on the spool to be expelled.

As mentioned, the telescopic pneumatic linear actuator 10 is supplied and actuated by compressed air, for example at a pressure of 6 bar, originating from compression means, such as for example a compressor, external thereto.

Such compressed air is introduced into the cavity 14 of the first annular cylinder 12 by passing through the at least one supply hole 38, which connects the hole 13 with the cavity 14.

From the cavity 14 of the first annular cylinder 12, the compressed air exerts a pushing force on the second annular cylinder 20, commencing the extended phase of the telescopic pneumatic linear actuator 10.

The second annular cylinder 20, once it has come into contact with the inner 16 and outer 18 stroke limiting rings of the first annular cylinder 12, covers the first half of the necessary stroke for the expulsion of the spools from the self-expanding spindles.

The compressed air then reaches the cavity 22 of the second annular cylinder 20, by passing through the at least one supply hole 46, which connects the cavity 22 with the cavity 14 of the first annular cylinder 12.

From the cavity 22 of the second annular cylinder 20, the compressed air exerts a pushing force on the annular piston 28, continuing the extended phase of the telescopic pneumatic linear actuator 10.

The annular piston 28, once it has come into contact with the inner 24 and outer 26 stroke limiting rings of the second annular cylinder 20, covers the second half of the necessary stroke for the expulsion of the spools from the self-expanding spindles, thus bringing the telescopic pneumatic linear actuator 10 according to the disclosure to the open configuration, i.e. in the fully extended phase.

The telescopic pneumatic linear actuator 10 fully extended, by way of the annular pusher plate 30 in direct contact with the spool to be expelled from the conventional self-expanding spindles, exerts a sufficiently high pushing force to enable the expulsion of the spool from the self-expanding spindles, unloading it in the center of the unwinding station area.

In practice it has been found that the disclosure fully achieves the set aim and objects. In particular, it has been seen that the telescopic pneumatic linear actuator, particularly for unwinders with movable arms, thus conceived makes it possible to overcome the qualitative limitations of the known art, since it makes it possible to exert a pushing force, for the expulsion of the spool from the self-expanding spindles, which is higher than current solutions, sufficient to cover all the various needs and to expel any type of spool of any mass, without limitations.

Another advantage of the telescopic pneumatic linear actuator, particularly for unwinders with movable arms, according to the disclosure consists in that it makes it possible to expel the spools from the self-expanding spindles and unload them correctly at the center of the unwinding station, even for spools that are partially used or which have damaged cores.

Another advantage of the telescopic pneumatic linear actuator according to the disclosure consists in that it has contained dimensions overall, both diametric and longitudinal, which are key to reclaiming useful spaces available for the angular movements of the moving arms of the unwinders and for the rotation and movement (loading and unloading) of spools supported by the self-expanding spindles, and also in order to enable an easy installation of the actuator between the moving arms of the unwinders and the self-expanding spindles, while furthermore preventing a widening of the structure of the moving arms.

Another advantage of the telescopic pneumatic linear actuator according to the disclosure consists in that it makes it possible to reduce the average times of the operations of loading and unloading the spools on the unwinders with movable arms.

Another advantage of the telescopic pneumatic linear actuator according to the disclosure consists in that it makes it possible to eliminate any kind of manual intervention necessary for the expulsion and unloading of the spools clamped on at least one self-expanding spindle, with a consequent increase of the level of safety for the operators and for the unwinding station in general.

Another advantage of the telescopic pneumatic linear actuator according to the disclosure consists in that it can be used both on newly-designed unwinders with movable arms and, without particular mechanical modifications, for upgrading existing unwinders with movable arms which do not have a system or servomechanism for the automatic expulsion and unloading of the spools.

Another advantage of the telescopic pneumatic linear actuator according to the disclosure consists in that it offers considerable simplification of construction, which makes it possible to facilitate the assembly operations and contain the production costs; such simplification of construction, furthermore, renders the telescopic pneumatic linear actuator according to the disclosure practically free from operating malfunctions and from operations of ordinary and extraordinary maintenance, with running costs close to zero.

Although the telescopic pneumatic linear actuator according to the disclosure has been conceived in particular for unwinders with movable arms in order to move, during the unloading operation, spools of paper, cardboard, corrugated cardboard and flexible laminates in general, supported by self-expanding spindles, it can also be used, more generally, for any type of machine tool in which its use can be found useful and for the movement of any object supported by a spindle.

The disclosure, thus conceived, is susceptible of numerous modifications and variations. Moreover, all the details may be substituted by other, technically equivalent elements.

In practice, the materials used, as well as the contingent shapes and dimensions, may be any according to the requirements and the state of the art.

What is claimed is:

1. A telescopic pneumatic linear actuator comprises a first annular cylinder, provided with a respective annular cavity delineated by an annular wall, a second annular cylinder, which can be inserted into and can slide within said annular cavity of said first annular cylinder and is provided with a respective annular cavity delineated by an annular wall, and an annular piston, which can be inserted into and can slide within said annular cavity of said second annular cylinder, said first and second annular cylinders and said annular piston being provided with respective holes for passage of a self-expanding spindle wherein the respective annular walls separate the respective cavities from the respective holes in the first and second annular cylinders, further comprising an annular pusher plate which can be fixed on said annular piston and is provided with a hole for passage of the self-expanding spindle.

2. The telescopic pneumatic linear actuator, according to claim 1, wherein each one of said first and second annular cylinders comprises an inner stroke limiting ring and an outer stroke limiting ring, which are fixed on an open side of said first and second annular cylinders along edges of said respective cavities.

3. The telescopic pneumatic linear actuator, according to claim 2, wherein each one of said inner stroke limiting rings comprises an outer anti-friction ring, and wherein each one of said outer stroke limiting rings comprises an inner anti-friction ring.

4. The telescopic pneumatic linear actuator, according to claim 1, wherein said second annular cylinder and said annular piston each comprise an outer gasket and an inner gasket, both for a pneumatic seal.

5. The telescopic pneumatic linear actuator, according to claim 1, wherein said second annular cylinder and said annular piston each comprise an outer anti-friction ring and an inner anti-friction ring.

6. The telescopic pneumatic linear actuator, according to claim 1, wherein said annular pusher plate is provided with longitudinally extended guides defined proximate to an edge thereof and adapted to allow a partial rotation of said annular pusher plate.

7. The telescopic pneumatic linear actuator, according to claim 1, wherein said hole of said annular pusher plate has a shape adapted to render said annular pusher plate integral with a self-expanding spindle.

8. The telescopic pneumatic linear actuator, according to claim 1, wherein said first and second annular cylinders each comprise at least one compressed air supply hole.

9. The telescopic pneumatic linear actuator, according to claim 1, wherein said first annular cylinder comprises flange with a plurality of fixing holes, said flange being configured to install and fix said telescopic pneumatic linear actuator on a bearing transmission shaft of an unwinder with movable arms.

* * * * *